US005415521A

United States Patent [19]

Hufnagel et al.

[11] Patent Number: 5,415,521

[45] Date of Patent: May 16, 1995

[54] AGGREGATE FOR FEEDING FUEL FROM SUPPLY TANK TO INTERNAL COMBUSTION ENGINE OF MOTOR VEHICLE

[75] Inventors: Klaus-Dieter Hufnagel, Moeglingen; Willi Strohl, Beilstein, both of Germany; Jaihind-Singh Sumal, W. Bloomfield; Steven E. Sims, Waterford, both of Mich.

[73] Assignee: Robert Bosch G.m.b.H., Stuttgart, Germany

[21] Appl. No.: 134,169

[22] Filed: Oct. 8, 1993

[30] Foreign Application Priority Data

Nov. 25, 1992 [DE] Germany ..... 42 39 488.0

[51] Int. Cl.[6] ..... F01D 3/00

[52] U.S. Cl. ..... 415/55.1

[58] Field of Search ..... 415/55.1, 55.2, 55.3, 415/55.4, 55.5

[56] References Cited

U.S. PATENT DOCUMENTS

| | | | |
|---|---|---|---|
| 4,451,213 | 5/1984 | Takei et al. | 415/55.5 |
| 4,915,582 | 4/1990 | Nishikawa | 415/55.1 |
| 4,958,984 | 9/1990 | Aoi et al. | 415/55.1 |
| 5,024,578 | 6/1991 | Vansadia | 415/55.1 |
| 5,080,554 | 1/1992 | Kamimura | 415/55.1 |
| 5,163,810 | 11/1992 | Smith | 415/55.1 |

FOREIGN PATENT DOCUMENTS

| | | | |
|---|---|---|---|
| 59262 | 5/1954 | France | 415/55.1 |
| 699744 | 12/1940 | Germany | 415/55.1 |
| 1403575 | 11/1968 | Germany | 415/55.1 |
| 38891 | 2/1987 | Japan | 415/55.1 |
| 125422 | 7/1949 | Sweden | 415/55.1 |

*Primary Examiner*—John T. Kwon
*Attorney, Agent, or Firm*—Michael J. Striker

[57] ABSTRACT

An aggregate for feeding fuel from a supply tank to an internal combustion engine of a motor vehicle has a feed pump formed as a flow pump and having a disk-shaped impeller and a pump chamber in which the impeller rotates and which is limited in an axial direction by two end walls spaced from one another and in a radial direction by a ring wall arranged so that substantially parallel axial gaps are formed between end surfaces of the impeller and end surfaces of the pump chamber facing the end surfaces of the impeller. Each of the axial gaps has an inner ring-shaped throttle gap with an inner throttle gap area and an outer ring-shaped throttle gap with an outer throttle gap area as considered in a radial direction and formed so that when the axial gaps are identical at any distance from the rotary axis the inner and outer throttle gap areas are identical, but when the axial gaps are not identical, then at a side of a smaller axial gap the inner throttle gap area is greater than the outer throttle gap area and at the side of a greater axial gap the outer throttle gap area is greater than the inner throttle gap area.

8 Claims, 5 Drawing Sheets

52
38
162
156
166
168
56
32
72
IV
164
46
44
48
42
26
68
64
66
62
50
30
54
III
57
74

AGGREGATE FOR FEEDING FUEL FROM SUPPLY TANK TO INTERNAL COMBUSTION ENGINE OF MOTOR VEHICLE

BACKGROUND OF THE INVENTION

The present invention relates to aggregate for feeding fuel from a supply tank to an internal combustion engine of a motor vehicle.

More particularly, it relates to such an aggregate which has a feed pump with a disk-shaped impeller rotating in a pump chamber, arranged so that between the end surfaces of the impeller and the associated end surfaces of the pump chamber, substantially parallel axial gaps are provided.

Aggregates of the above-mentioned general type are known in the art. In a known feed aggregate in which the above-mentioned axial gaps are maintained between the mutually parallel end surfaces of the impeller and the mutually parallel end walls of the pump chamber, one axial gap can move to zero while another axial gap can correspondingly increase. Since the impeller is displaced due to corresponding action in the direction of the rotary axis in the pump chamber, the impeller is blocked in its disadvantageous eccentric position, because no hydraulic force acts on the impeller and moves it back to its central position.

SUMMARY OF THE INVENTION

Accordingly, it is an object of the present invention to provide an aggregate for feeding fuel from a supply tank to an internal combustion engine of a motor vehicle, which avoids the disadvantages of the prior art.

In keeping with these objects and with others which will become apparent hereinafter, one feature of the present invention resides, briefly stated, in an aggregate for feeding fuel from a supply tank to an internal combustion engine of a motor vehicle, in which, with respect to the impeller, each axial gap has a ring-shaped inner throttle gap and a ring-shaped outer throttle gap, the inner throttle gap area is equal to the outer throttle gap area when the opposite axial gaps are equal at any distance from the rotary axis, and with the unequal axial gaps, at the side of the smaller axial gap, the inner throttle gap area is greater than the outer throttle gap area, or at the side of the greater axial gap, the outer throttle gap area is greater than the inner throttle gap area.

When the feed aggregate is designed in accordance with the present invention, it has the advantage that due to the inventive arrangement and design of the throttle gaps, always an automatic return of the impeller to its advantageous medium position is provided.

In accordance with another advantageous feature of the present invention, the end surfaces of the pump chamber facing one another are provided with pockets which are open to the rotary axis of the impeller. When the feed aggregate is designed in accordance with these features, the impeller tilted from the rotary plane can be automatically inclined to its original operating position.

In accordance with another feature of the present invention, a rim of pockets is arranged in each end wall opposite to one another. The depths of the pockets in the direction of the rotary axis of the impeller can be equal to at most 2 mm.

In accordance with still another feature of the present invention the impeller can be provided with several passages extending parallel to the rotary axis and located on a circle which is close to the rotary axis.

The impeller can be provided with a rim of vanes arranged on its outer periphery and having free ends connected by an outer ring.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
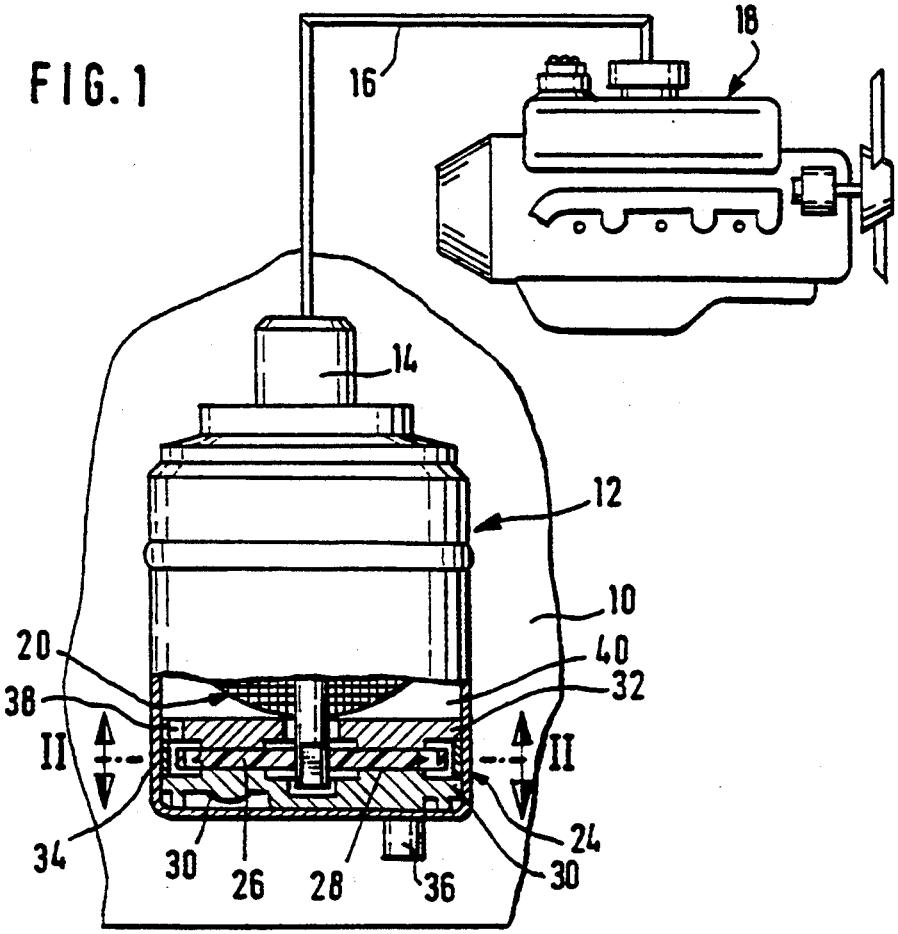
FIG. 1 is a view schematically showing an arrangement for supplying an internal combustion engine of a motor vehicle with fuel from a supply tank, with a feed aggregate having a flow pump in accordance with the present invention.

FIG. 1 is a view showing a part of a fuel supply tank 10 in which a fuel feed aggregate 12 is arranged. A pressure conduit 16 is connected with a pressure pipe 14 of the fuel feed aggregate 12 and leads to an internal combustion engine 18 of a motor vehicle. During the operation of the internal combustion engine 18 the fuel feed aggregate 12 supplies fuel from the supply tank 14 to the internal combustion engine 18. The fuel feed aggregate is provided with an electric drive motor 20 with an armature shaft 22 connected with a feed member of a feed pump 24.

Figures 2, 3, 4:
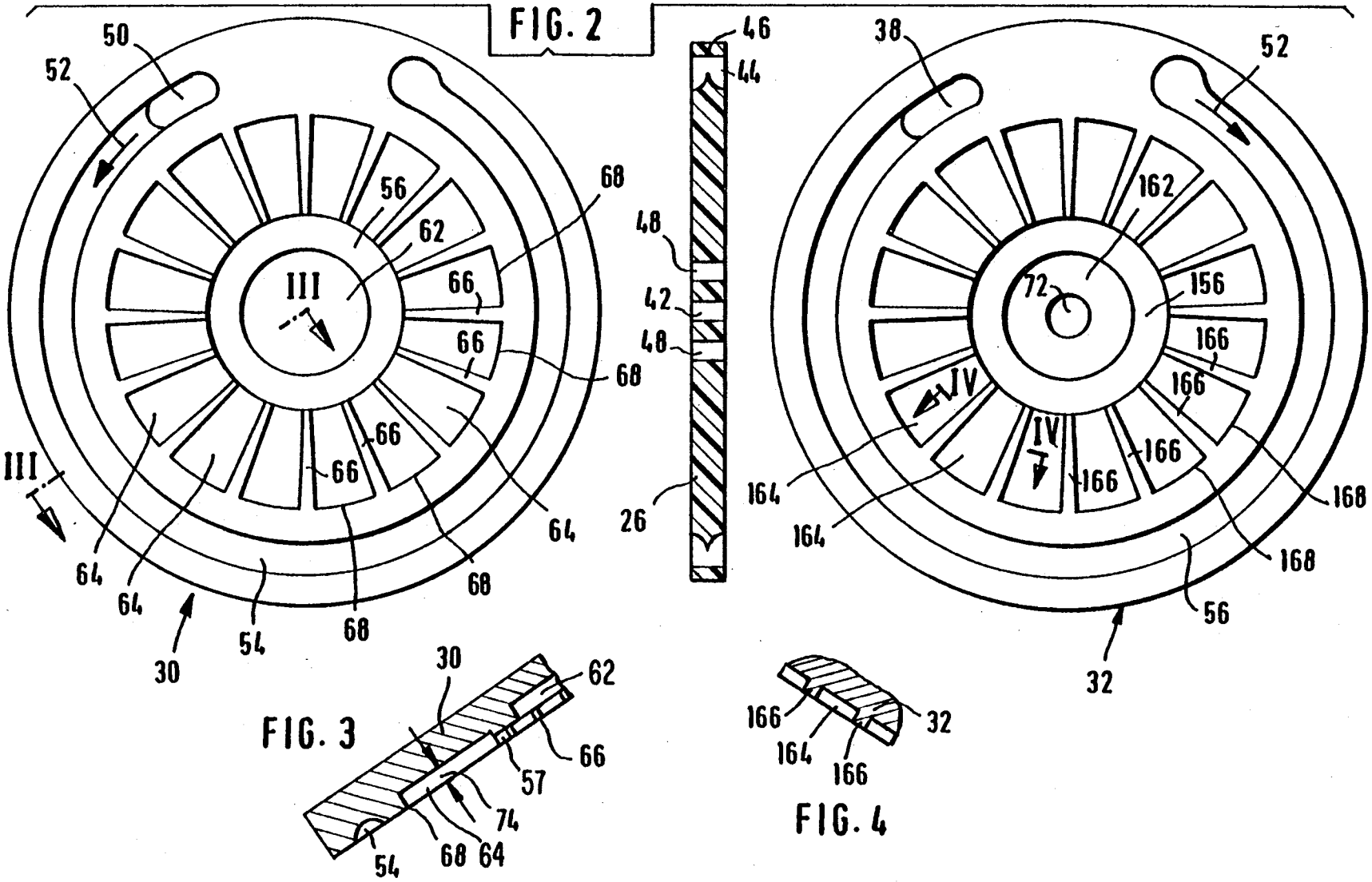
FIG. 2 is a view showing a section through a pump chamber of the flow pump of FIG. 1, taken along the line II—II, on an enlarged scale.
FIG. 3 is a view showing a partial section through a housing part of the flow pump taken along the line III—III in FIG. 2.
FIG. 4 is a view showing a partial section through a housing part of the flow pump, taken along the line IV—IV in FIG. 2.
Figure 2A:
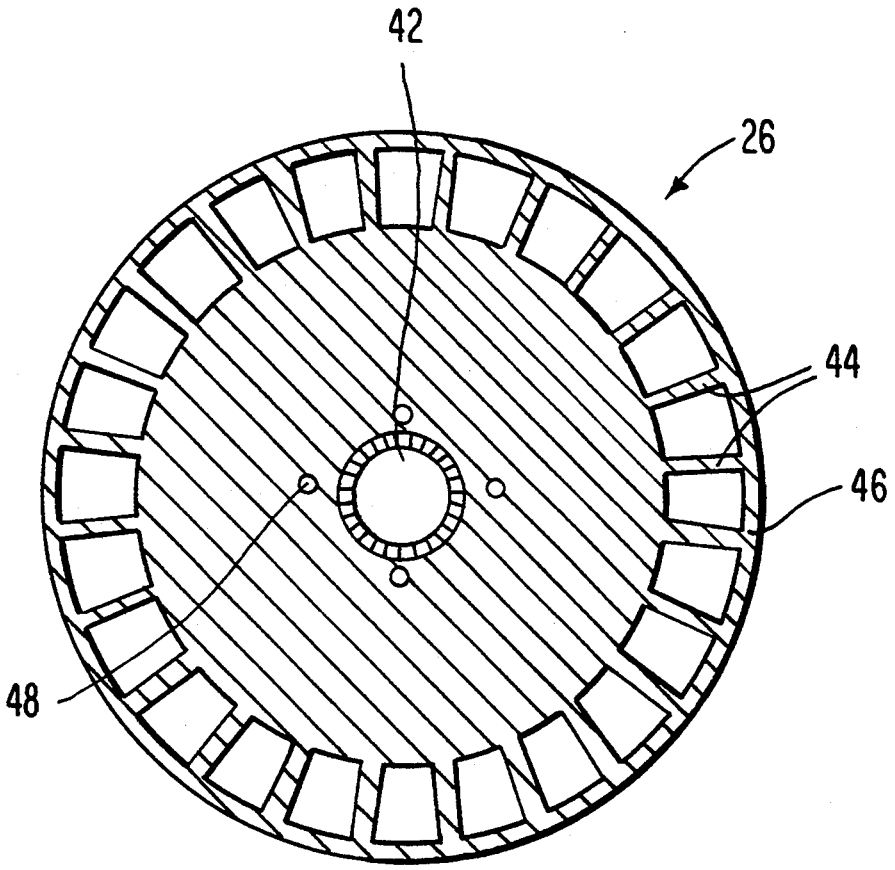
FIG. 2*a* is an axial view of an impeller of the pump of the feed aggregate.

The feed pump 24 is formed as a flow pump and has the feed member formed as an impeller 26 shown in detail in FIGS. 1 and 2. The impeller 26 rotates in a pump chamber 28. The pump chamber 28 is limited in an axial direction by end walls of housing parts 30 and 32, which similarly to the electric drive motor 20, are also arranged in an aggregate housing 34. In the radial direction, the pump chamber 28 is directly limited by a ring wall 29 shown in FIG. 5. The housing part 30 of the feed pump 24 has a suction pipe 36, through which the feed pump 24 aspirates fuel from the supply tank 10. The housing part 32 of the feed pump 24 has a pressure opening 38 which connects the pump chamber 28 with an inner chamber 40 accommodating the electric drive motor 20 of the feed aggregate 12. The inner chamber 40 of the feed aggregate 12 is connected with the pressure pipe 14 so that the fuel aspirated through the pipe 36 after passing through the feed aggregate can be supplied through the pressure pipe 14 into the pressure conduit 16.

As can be seen from FIG. 1, the impeller 26 is disk-shaped. It has a central opening 42 for receiving the armature shaft 22 of the electric motor 20. On its outer region, the impeller 26 is provided with a rim of vanes 44 as can be seen from FIG. 2. The outer ends of the vanes 44 are connected with one another by a circumferential ring 46. Several passages or pressure equalizing openings 48 extend through the disk-shaped impeller 26 near its central opening 42. As can be seen from FIG. 2, the housing part 30 which belongs to the pump is provided with a suction opening 50 which coincides with the opening of the pressure pipe 36 in the assembled condition of the aggregate. An approximately ring-shaped feed passage 54 extends from the suction opening 50 in a rotary direction of the impeller 26 in accordance with the arrow 52. A corresponding feed passage 56 is arranged in another pump housing part 33 shown in FIG. 2. The feed passage 56 in the pump housing part 32 starts opposite to the suction opening 50 in the housing part 30 and ends where it opens into the pressure opening 38.

Figure 5:
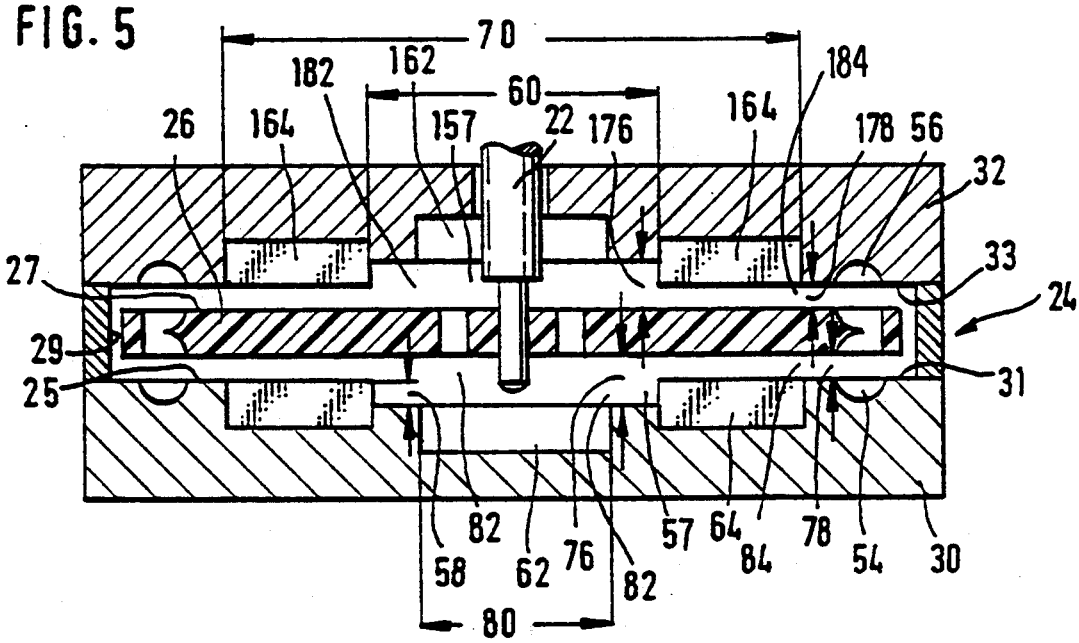
FIG. 5 is a view showing the flow pump of FIG. 1 on an enlarged scale, wherein the impeller of the pump is located at identical distances from opposite walls of a pump chamber in which the impeller rotates.

As can be seen from FIGS. 2 and 5, the housing part 30 has a central depression 57 with a depth 58 shown in FIG. 5. The diameter of the central depression 57 is identified with reference numeral 60 in FIG. 5. A central recess 62 is provided inside the central depression 57 in the housing part 30. Its diameter is greater than the partial circle diameter on which the throughgoing openings 48 of the impeller 26 are arranged.

As can be further seen from FIGS. 2 and 5, a rim of pockets 64 extends from the central depression 57 of the housing part 30 and is open-edged toward the depression 57. The depth of the pockets 64 is greater than the depth 58 of the central depression 57. The neighboring pockets 64 are separated from one another by webs 66. They end with their outer edges 68 located on a common circular line. The circular line has a diameter identified with reference numeral 70 in FIG. 5. What has been said with respect to the housing part 30 is true also with respect to the housing part 32. The corresponding reference numerals are greater by 100 than the reference numerals for the housing part 30. In addition to the above-described elements, the housing part 32 also has a central throughgoing opening 72 for the armature shaft 22 of the electric drive motor 20. It therefore can be seen that the pockets 64,164 are open both toward the depression 56,156 and toward the impeller 26. FIG. 5 further shows that the pockets 64,164 are arranged on each inner end wall of the housing parts 30 and 32 opposite to one another. The depth 74 of the pockets shown in FIG. 3 amounts to at most 2 mm when measured in the direction of the rotary axis of the impeller 26.

As can be seen from FIG. 5, the impeller 26 is located in its advantageous medium position between the facing end wall 31 of the housing part 30 and the facing end wall 33 of the housing part 32. In this medium position substantially parallel axial gaps are produced between the facing end walls 31 and 33 of the housing parts 30 and 32 and the end surfaces 25 and 27 of the impeller 26. These axial gaps are composed of a greater inner axial gap 76 and a smaller outer axial gap 78. Both parts of the axial gap are identical in a normal position of the impeller in FIG. 5 at both sides of the impeller 26. A third, inner axial gap is produced in the region of both recesses 62 and 162, which in its extension in the direction of the rotary axis of the impeller 26 is the greatest. As can be seen from FIG. 5, the diameter of the central recess 62 is identified with reference numeral 80. Starting from the rotary axis of the impeller 26, the feed pump 24 has therefore a first inner throttle point 82 or 182 which is formed in the region of the transition from the recess 62 or 162 to the depression 57 or 157 of the housing parts 30 and 32 and the associated end surfaces 25 and 27 of the impeller 26. A second, outer throttle point 84 or 184 is formed at the location where the pockets 64 in the chamber walls 30 and 32 and at the diameter 70. Since the throttle points 82,182 and 84,184 are ring-shaped and surround the rotary axis of the impeller 26, they can be also identified as ring gaps.

Figure 6:
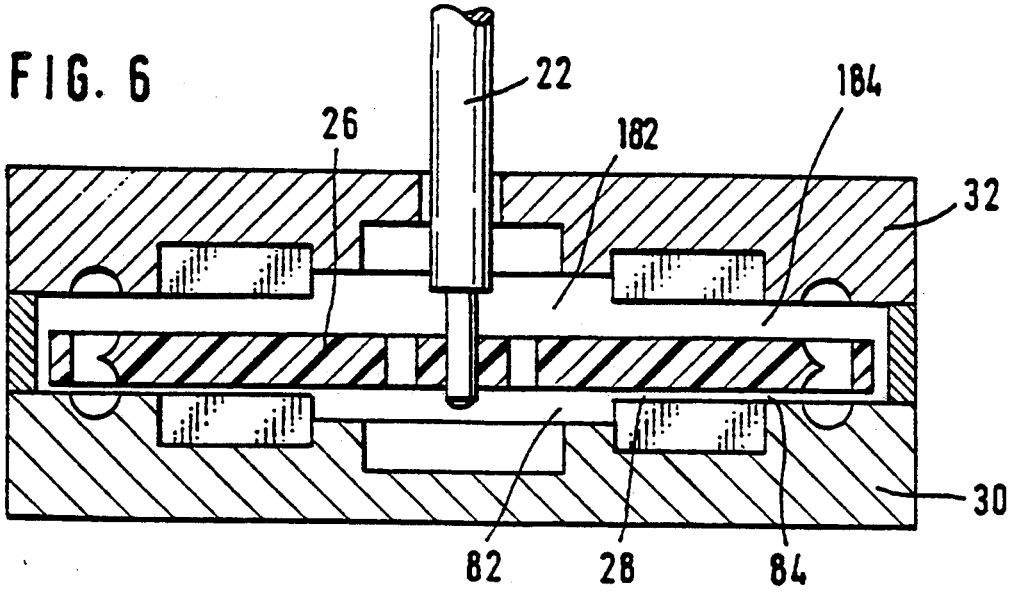
FIG. 6 is a view showing the pump of FIG. 5, with the impeller approaching one chamber wall.

The determination of all ring gaps 82,182 and 84,184 is selected so that the inner ring-shaped throttle gap areas produced from the diameter 80 and the dimension 76 are equal to the ring-shaped throttle gap areas of the outer throttle point 84,184 produced from the diameter 70 and the dimension 78 of the outer throttle gap, when the impeller 26 is located in its desired medium position of FIG. 5. Further, the determination of the diameter 70 and 80 in connection with the gap sizes of the throttle points 82 and 84 is selected so that, with the eccentric operational position of the impeller 26 or in other words with the nonequal axial gaps, at the side of the smaller axial gap the inner throttle gap area 82,182 is greater than the outer throttle gap area 84,184, and at the side of the greater axial gap the outer throttle gap area is greater than the inner throttle gap area. Such an operational position is shown in FIG. 6. The above-described displacement can occur when, for example, the feed aggregate is arranged in the tank 10 so that the rotary axis of the impeller is located in the upright position. The insignificant axial gap of the armature shaft can result in an eccentric arrangement of the impeller in the pump chamber 28. From the above-described, it can be seen that the determination of the diameter 70 and 80 as well as both gap widths 82 and 84 must be performed in accordance with an equation presented hereinbelow:

Diameter 80×gap inner [82]=Diameter 70×gap outer [84].

It therefore can be seen that the dimension 58 of a required determination within the equation is needed, since thereby the ring gap surface of the throttle point 84,124 is decisive to the diameter 70.

Figure 8:
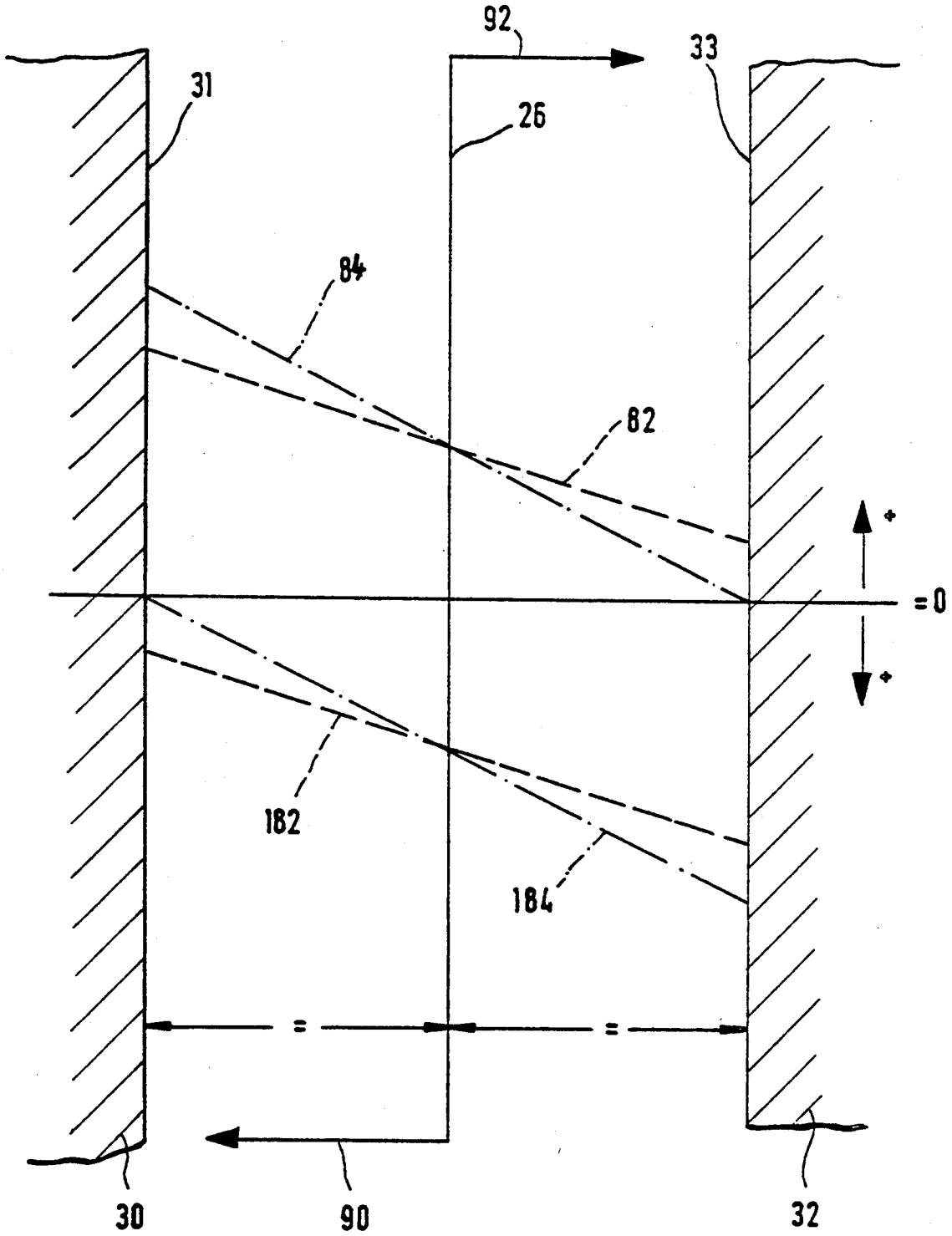
FIG. 8 is a view showing a graphic representation of the hydraulic forces which act during possible operational positions of the impeller in the pump chamber.

FIG. 8 shows the action of the hydraulic forces on the impeller 26. The impeller 26 is identified with a line which is located at identical distances from both end surfaces 31 and 33 of the pump housing parts 30 and 32. It can be seen from this Figure that in the desired, advantageous medium position of the impeller 26, the inner throttle gap area identified in FIG. 8 with a broken line and reference numeral 84 is identical to the outer throttle gap area 82 identified by the dashed-dotted line. This is confirmed in the bottom portion of FIG. 8 in that both lines 82 and 84 intersect in the region of the impeller 26. When for some reason the impeller 26 is displaced in the direction of the arrow 90 from its medium position and thereby the axial gaps become not identical, then at the side of the smaller axial gap which is the left side in FIG. 8, the inner throttle gap area 182 is greater than the outer throttle gap area 184. Simultaneously, at the side of the greater axial gap, which is the right side in FIG. 8, the outer throttle gap area 84 is greater than the inner throttle gap area 82. The other possible case is shown in the top portion of FIG. 8, wherein the impeller 26 is displaced in the direction of the arrow 92 from its shown medium position and approaches the end surface 33. In this case also at the side of the smaller axial gap, the inner throttle gap area 82 is greater than the outer throttle gap area 84. Simultaneously, at the side of the greater axial gap which is the left side in the drawing, the outer throttle gap area 184 is greater than the inner throttle gap area 182.

The change of the throttle gap areas influences the hydraulic forces acting on the impeller so that the hydraulic forces at the side of the smaller axial gap are always greater than at the side of the greater axial gap. Therefore, an automatic restoring movement of the impeller in the direction toward its medium position is ensured.

Figure 7:
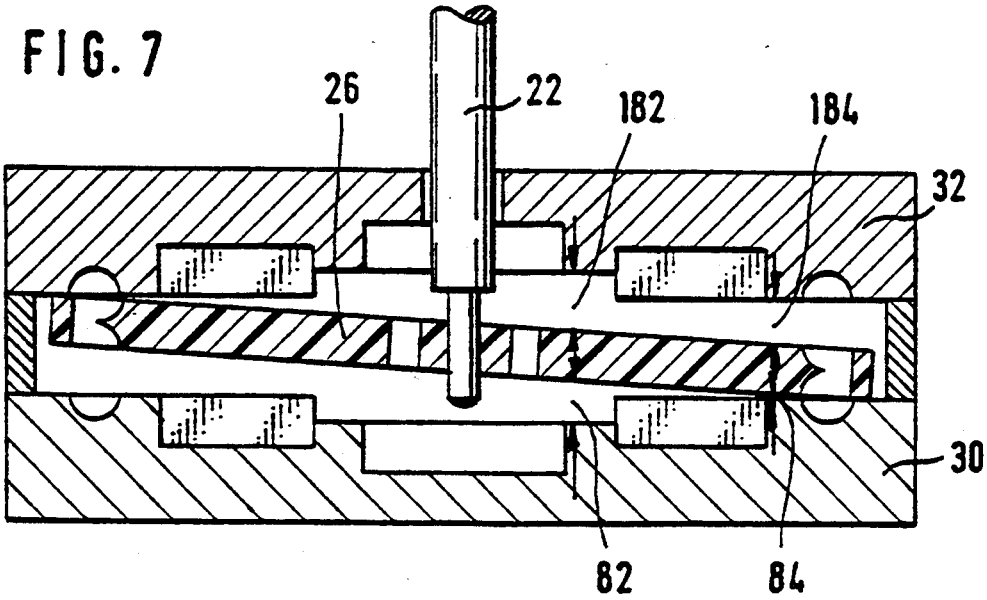
FIG. 7 is a view showing the pump of FIG. 5 with the impeller tilted in the pump chamber.

This is also true for the case when the impeller 26 is tilted in the pump chamber 28 due to fit or bearing play as shown in FIG. 7. In this case also the position of the impeller 26 is restored in a desired direction, especially by the arrangement of the pockets 64 and 164 in both housing parts 30 and 32 of the feed pump 24.

It will be understood that each of the elements described above, or two or more together, may also find a useful application in other types of constructions differing from the types described above.

While the invention has been illustrated and described as embodied in an aggregate for feeding fuel from a supply tank to an internal combustion engine of a motor vehicle, it is not intended-to be limited to the details shown, since various modifications and structural changes may be made without departing in any way from the spirit of the present invention.

without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An aggregate for feeding fuel from a supply tank to an internal combustion engine of a motor vehicle, comprising a feed pump formed as a flow pump and having a disk-shaped impeller, a pump chamber in which said impeller rotates about a rotary axis, said pump chamber being limited in an axial direction by two end walls spaced from one another and in a radial direction by a ring wall arranged so that substantially parallel axial gaps are formed between end surfaces of said impeller and end surfaces of said pump chamber facing said end surfaces of said impeller, each of said axial gaps having an inner ring-shaped throttle gap with an inner throttle gap area and an outer ring-shaped throttle gap with an outer throttle gap area as considered in a radial direction to said rotary axis and formed so that when said impeller is in a medium axial position in said pump chamber and said axial gaps are axially identical at any distance from said rotary axis, said inner and outer throttle gap areas are identical, but when said impeller is axially displaced from said medium axial position and said axial gaps are not axially identical so that at one axial side of said impeller an axially smaller axial gap is formed and at the other axial side of said impeller an axially greater axial gap is formed, then at a side of said axially smaller axial gap said inner throttle gap area is greater than said outer throttle gap area and at the side of said axially greater axial gap said outer throttle gap area is greater than said inner throttle gap area.

2. An aggregate as defined in claim 1, wherein said end walls are provided with substantially ring-shaped grooves located opposite to one another and formed so that when considered in a rotary direction of said impeller, one of said grooves starts at a suction opening extending through said end wall in which said one groove is formed, while another of said grooves ends at a pressure opening extending through said end wall in which said another groove is formed.

3. An aggregate as defined in claim 1, wherein said end surfaces of said pump chamber are provided with pockets which are opened toward said rotary axis of said impeller and toward said impeller.

4. An aggregate as defined in claim 3, wherein each of said end walls has a plurality of said pockets which are located opposite to one another.

5. An aggregate as defined in claim 3, wherein said pockets have a depth which is at most equal to 2 mm as considered in direction of said rotary axis of said impeller.

6. An aggregate as defined in claim 1, wherein said impeller is provided with several passages which extend parallel to said rotary axis and are located on a partial circle near said rotary axis.

7. An aggregate as defined in claim 1, wherein said impeller has an outer periphery provided with a rim of vanes having free ends; and further comprising an outer ring which connects said free ends of said vanes with one another.

8. An aggregate for feeding fuel from a supply tank to an internal combustion engine of a motor vehicle, comprising a feed pump formed as a flow pump and having a disk-shaped impeller, a pump chamber in which said impeller rotates about a rotary axis, said pump chamber being limited in an axial direction by two end walls spaced from one another and in a radial direction by a ring wall arranged so that substantially parallel axial gaps are formed between end surfaces of said impeller and end surfaces of said pump chamber facing said end surfaces of said impeller, each of said axial gaps having an inner ring-shaped throttle gap with an inner throttle gap area and an outer ring-shaped throttle gap with an outer throttle gap area as considered in a radial direction to said rotary axis and formed so that when said impeller is in a medium axial position in said pump chamber and said axial gaps are axially identical at any distance from said rotary axis, said inner and outer throttle gap areas are identical, but when said impeller is axially displaced from said medium axial position and said axial gaps are not axially identical so that at one axial side of said impeller an axially smaller axial gap is formed and at the other axial side of said impeller an axially greater axial gap is formed, then at a side of said axially smaller axial gap said inner throttle gap area is greater than said outer throttle gap area and at the side of said axially greater axial gap said outer throttle gap area is greater than said inner throttle gap area, said throttle gaps being formed so that a dimension of said ring-shaped inner throttle gap with a given dimension of said ring-shaped outer throttle gap corresponds to the following formula:

$$\frac{D1 \times \text{gap size}}{D2}$$

wherein D1 is a diameter of an outer throttle point corresponding to sad outer throttle gap, D2 is a diameter of a central recess which forms an inner axial gap, and the gap size is the size of said ring-shaped outer throttle gap.

* * * * *